US006659789B2

(12) United States Patent
Nagamine et al.

(10) Patent No.: US 6,659,789 B2
(45) Date of Patent: Dec. 9, 2003

(54) ELECTRICAL CONNECTOR ASSEMBLY AND CONNECTOR USED FOR IT

(75) Inventors: Akira Nagamine, Aichi (JP); Sunao Mizuno, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/191,750

(22) Filed: Jul. 9, 2002

(65) Prior Publication Data

US 2003/0008546 A1 Jan. 9, 2003

(30) Foreign Application Priority Data

Jul. 9, 2001 (JP) ..... 2001-207193

(51) Int. Cl.[7] ..... H01R 13/639
(52) U.S. Cl. ..... 439/352
(58) Field of Search ..... 439/352, 489, 439/350, 351, 353–358

(56) References Cited

U.S. PATENT DOCUMENTS

| | | | | | |
|---|---|---|---|---|---|
| 5,879,180 | A | * | 3/1999 | Iwahori et al. | 439/352 |
| 5,919,056 | A | * | 7/1999 | Suzuki et al. | 439/352 |
| 6,231,368 | B1 | * | 5/2001 | Murakami et al. | 439/352 |
| 6,257,915 | B1 | * | 7/2001 | Endo | 439/357 |
| 6,332,804 | B2 | * | 12/2001 | Kurimoto et al. | 439/489 |
| 6,383,009 | B2 | * | 5/2002 | Kawase et al. | 439/352 |
| 6,406,319 | B2 | * | 6/2002 | Pederson et al. | 439/352 |

FOREIGN PATENT DOCUMENTS

| | | |
|---|---|---|
| JP | 3-285280 | 12/1991 |
| JP | 8-264229 | 10/1996 |
| JP | 9-17505 | 1/1997 |
| JP | 2647335 | 5/1997 |
| JP | 2647336 | 5/1997 |

OTHER PUBLICATIONS

Patent Abstracts of Japan, Publication No.: 06–208865, Publication Date: Jul. 26, 1994, 1 page.

Patent Abstract of Japan, Publication No.: 06–208867, Publication Date: Jul. 26, 1994, 1 page.

Patent Abstracts of Japan, Publication No.: 03–285280, Publication Date: Dec. 16, 1991, 1 page.

Patent Abstracts of Japan, Publication No.:08–264229, Publication Date: Oct. 11, 1996, 1 page.

Patent Abstracts of Japan, Publication No.: 09–017505, Publication Date: Jan. 17, 1997, 1 page.

* cited by examiner

*Primary Examiner*—Gary Paumen
*Assistant Examiner*—James R. Harvey
(74) *Attorney, Agent, or Firm*—Rosenthal & Osha L.L.P.

(57) ABSTRACT

An electrical connector assembly of the present invention has a pair of connector housings 2, 3 able to be fitted, and a lock arm 4 engaged with one 2 of these connector housings and holding a fitting state of the pair of connector housings when the above pair of connector housings 2, 3 is fitted. This lock arm 4 has a fitting lock portion 34 fitted to the other connector housing 3, and an engaging lock portion 35 engaged with one connector housing 2 in a releasing direction of the above fitting lock portion 34. The above fitting lock portion 34 and the above engaging lock portion 35 are arranged such that the above engaging lock portion 35 prevents the release of the above fitting lock portion 34 when only the above one connector housing 2 begins to be separated, and such that release of the above fitting lock portion 34 is not prevented by the above engaging lock portion 35 when the above lock arm 4 begins to be separated from the above other connector housing 3 together with the above one connector housing 2.

4 Claims, 7 Drawing Sheets

SEPARATING STATE

FITTING STATE

SEPARATION PREVENTING STATE

SEPARATING STATE

ELECTRICAL CONNECTOR ASSEMBLY AND CONNECTOR USED FOR IT

TECHNICAL FIELD OF THE INVENTION

The present invention relates to a connector assembly having a connector position assurance device for assuring the fitting of connectors fitted to each other, and a connector used in the connector assembly.

BACKGROUND OF THE INVENTION

An electrical connector assembly having a CPA (connector position assurance device) is conventionally known. A main function of the connector position assurance device is to prevent connectors from being separated from each other by preventing the flexure of a latch for maintaining a fitting state of the connectors fitted to each other. Further, it is required in the connector position assurance device that a worker can rapidly fit the connectors to each other, and the worker confirms the complete fitting state. These requirements are particularly important in the field of an automobile industry required the connection reliability of electrical system and required to minimize the labor of manufacture.

The electrical connector assembly having the connector position assurance device having such a function is disclosed in Japanese Patent Nos. 2647335 and 2647336 and Japanese Patent Laid-Open No. 264229/1996, etc. The connector position assurance device is attached to one of a pair of connector housings through a flexible connecting member so as not to be separated from each other. After the pair of connector housings is fitted, the fitting state of the pair of connector housings is locked by inserting the above connector position assurance device into the connector housings. When the fitting of the pair of connector housings is insufficient, connector position assurance device can not be inserted until normal positions of the connector housings. Therefore, the worker can visually confirm the incomplete fitting of the connector housings.

This connector position assurance device was separated until a fitting time as a separate body from the pair of connector housings able to be fitted. Therefore, the connector position assurance device is treated as a separate member so that a work step is added in an assembly line and assembly steps become complicated.

Therefore, another electrical connector assembly is proposed. In this electrical connector assembly, the connector position assurance device is temporarily engaged with one of the pair of connector housings able to be fitted, and is arranged such that the connector position assurance device is slid from a temporary engaging position to a main engaging position only when the above pair of connector housings is fitted. The electrical connector of this kind is disclosed in Japanese Patent Laid-Open Nos. 285280/1991 and 17505/1997, etc. When one of the pair of connector temporarily engaged with the connector position assurance device fits to the other connector housing, the connector position assurance device is advanced until a position for preventing lock release of the mutual fitting of the connector housings, and is engaged with the connector housings. The pair of connector housings cannot be separated from each other unless the connector position assurance device is again pulled and returned until the temporary engaging position.

In accordance with the electrical connector assembly including such a connector position assurance device, the mutual fitting of the connector housings is locked by mounting the connector position assurance device to the connector housings, or inserting the connector position assurance device from the temporary engaging position to the main engaging position. The lock of the mutual fitting of the connector housings is released by detaching the connector position assurance device from the connector housings, or returning the connector position assurance device from the main engaging position to the temporary engaging position. Therefore, two operations constructed by a pulling-extracting operation of the connector position assurance device and a pulling-extracting operation of the pair of connector housings are included in the release of the fitting of the pair of connector housings.

SUMMARY OF THE INVENTION

A main object of the present invention is to provide an electrical connector assembly including the connector position assurance device and able to simply perform attaching and detaching operations of the pair of connector housings, and a connector used in the electrical connector assembly.

An electrical connector assembly of the present invention comprises a pair of connector housings (2) (3) able to be fitted, and a lock arm (4) engaged with one (2) of these connector housings (2) (3) and holding a fitting state of the pair of connector housings when the above pair of connector housings (2) (3) is fitted;

wherein the above lock arm (4) has a fitting lock portion (34) fitted to the other connector housing (3), and an engaging lock portion (35) engaged with one connector housing (2) in a releasing direction of the above fitting lock portion (34).

The above engaging lock portion (35) prevents the release of the above fitting lock portion (34) when only the above one connector housing (2) begins to be separated. The release of the fitting lock portion (34) is not prevented by the above engaging lock portion (35) when the above lock arm (4) begins to be separated from the above other connector housing (3) together with the above one connector housing (2).

In accordance with this electrical connector assembly, when only one connector housing (2) begins to be separated, the lock arm (4) fitted to the other connector housing (3) by the fitting lock portion (34) is left. The engaging lock portion (35) engaged with one connector housing (2) attains an operating state and prevents the release of the above fitting lock portion (35). Therefore, the separation of the pair of connector housings (2) is prevented when only one connector housing (2) begins to be separated by such means as pulling an electrical wire.

When the lock arm (4) engaged with one connector housing (2) begins to be separated from the other connector housing (3) together with this one connector housing (2), the lock arm (4) fitted to the other connector housing (2) by the fitting lock portion (34) is moved together with one connector housing (2). Therefore, the engaging lock portion (35) engaged with one connector housing (2) attains a releasing state so that the release of the above fitting lock portion (34) is not prevented. Therefore, when the lock arm (4) or both the lock arm (4) and one connector housing (2) are pulled, the pair of connector housings (2) (3) is separated.

In the electrical connector assembly of the present invention, it is preferable that the above lock arm (4) has an elastic arm (33), and the above fitting lock portion (34) and the above engaging lock portion (35) are arranged at the tip of this elastic arm (33) such that operating directions of the fitting lock portion (34) and the engaging lock portion (35) are opposed to each other.

In accordance with this electrical connector assembly, the above fitting lock portion (34) and the above engaging lock portion (35) are arranged at the tip of the elastic arm (33) such that the operating directions of the fitting lock portion (34) and the engaging lock portion (35) are opposed to each other. Therefore, when the engaging lock portion (35) is located in a lock position, the fitting lock portion (34) is also located in the lock position. When the engaging lock portion (35) is located in a releasing position, the fitting lock portion (34) is also located in the releasing position.

In the electrical connector assembly of the present invention, it is preferable that the above lock arm (4) is movably arranged in a fitting direction with respect to one connector housing (2), and the engaging lock portion (35) is switched to an engaging position and a releasing position by this movement.

In accordance with this electrical connector assembly, the lock arm (4) is movably arranged in the fitting direction with respect to one connector housing (2). Therefore, the engaging position and the releasing position of the engaging lock portion (35) are switched by a slight axial movement of the lock arm (4).

In a connector of the present invention, a connector position assurance device (4) having an elastic arm (33) for fitting to a mating side connector (3) is engaged with the interior of a connector housing (2) fitted to the mating side connector (3). An engaging portion (35) against the above connector housing (2) is arranged on a side directed to the exterior of the tip of the above elastic arm (33). A fitting portion (34) against the mating side connector (3) is arranged on a side directed to the interior of the tip of the above elastic arm (33). The above elastic arm (33) is movably engaged with the above connector housing (3) in an axial direction in a position engaged with the above engaging portion (35) and a position disengaged from the engaging portion (35). The above engaging portion (35) is located in the engaging position when the above mating side connector (3) begins to be detached from the above connector housing (2). The above engaging portion (35) is located in the disengaging position when both the above connector housing (2) and the above elastic arm (33) begin to be detached from the above mating side connector (3).

In accordance with this connector, the fitting portion (34) to the mating side connector (3) is arranged at the tip of the elastic arm (33) engaged with one connector housing (2). Therefore, the engaging portion (35) at the tip of the elastic arm (33) is located in the engaging position or the releasing position against one connector housing (2) by the axial relative movement of one connector housing (2). Simultaneously the above fitting portion (34) can be switched to the fitting position or the releasing position for the mating side connector.

DESCRIPTION OF THE PREFERRED EMBODIMENTS

An electrical connector assembly with a connector position assurance device in a preferred embodiment mode of the present invention and a connector used in this electrical connector assembly will next be explained in detail with reference to the drawings.

Figure 1:
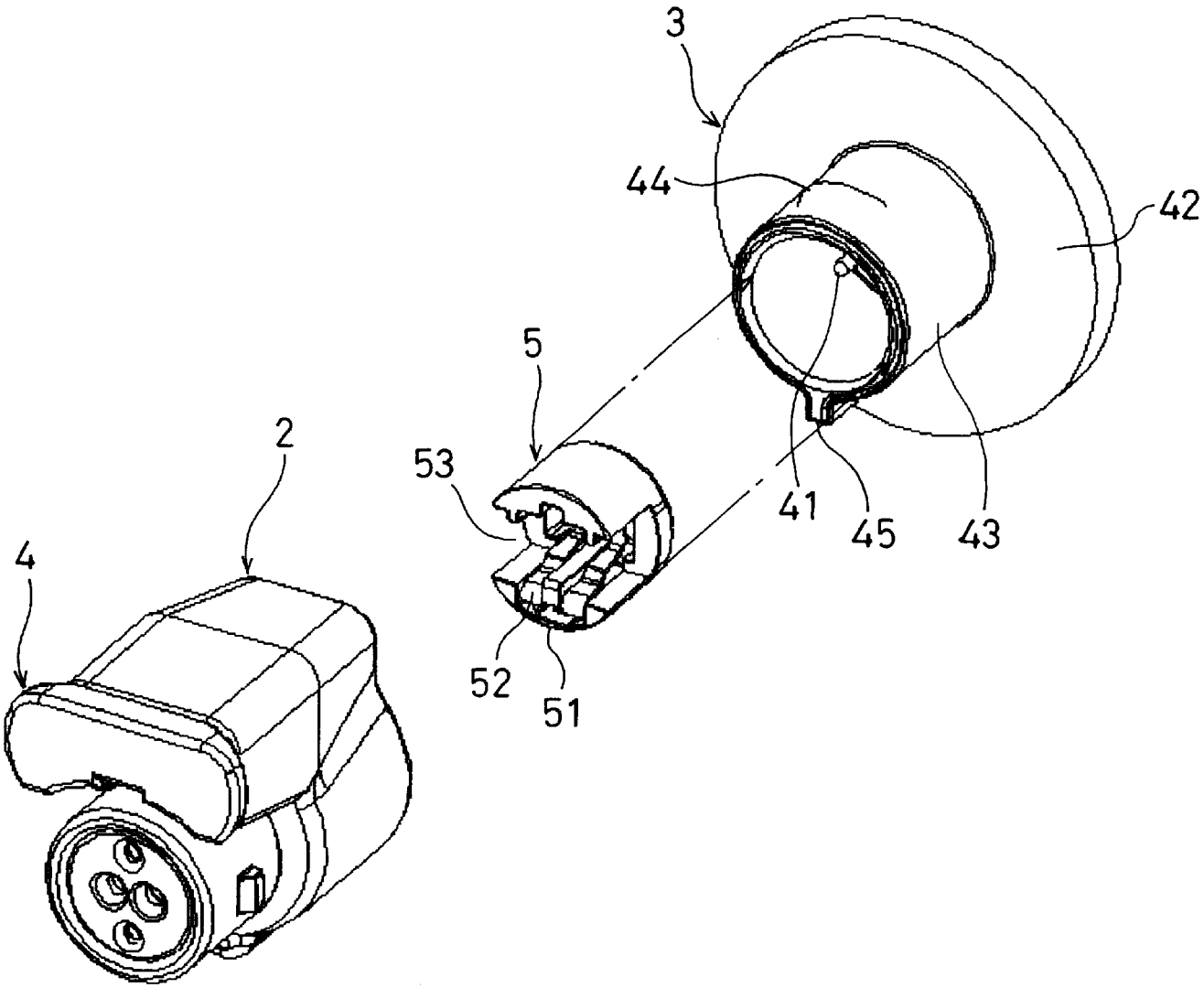
FIG. 1 is an exploded perspective view of a connector assembly with a connector position assurance device in a preferred embodiment mode of the present invention.
Figure 2:
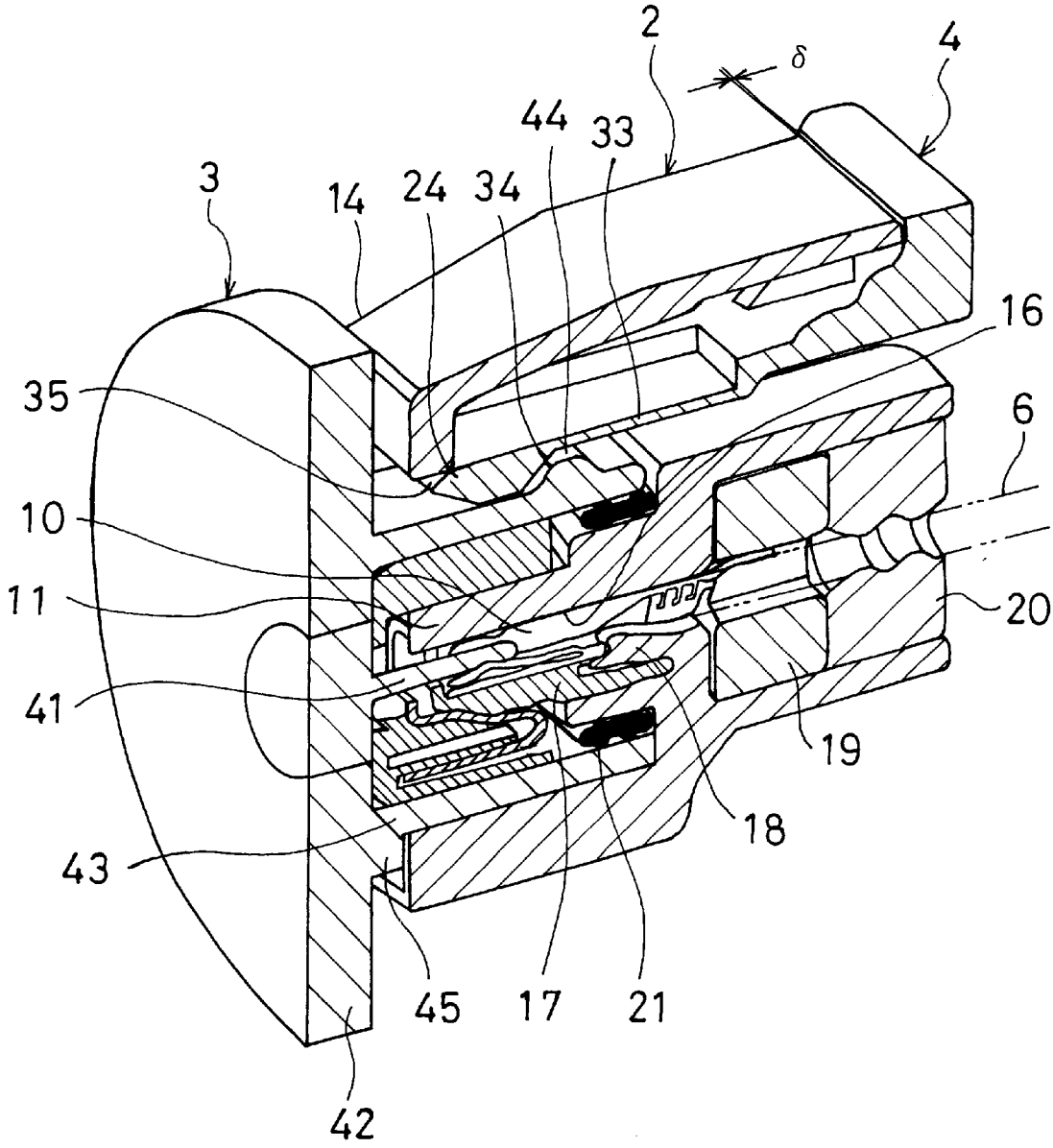
FIG. 2 is a perspective view of a side section of the connector assembly with the connector position assurance device in the preferred embodiment mode of the present invention in a fitting state.

FIG. 1 is an exploded perspective view of an electrical connector assembly with a connector position assurance device in a preferred embodiment mode of the present invention. FIG. 2 is a perspective view of a side section of the electrical connector assembly with the connector position assurance device in the preferred embodiment mode of the present invention in a fitting state.

In FIG. 1, the electrical connector assembly (the connector assembly with the connector position assurance device) 1 has a plug type housing (connector housing) 2 and a receptacle type housing (connector housing) 3. The plug type housing 2 is a female connector on the side of an unillustrated electrical wire, and a lock arm 4 as the connector position assurance device is engaged with the plug type housing 2 in advance. The receptacle type housing (connector housing) 3 is a male connector on the holder side of a squib and a short circuit insert 5 is mounted to the receptacle type housing 3 in advance.

Figure 3:
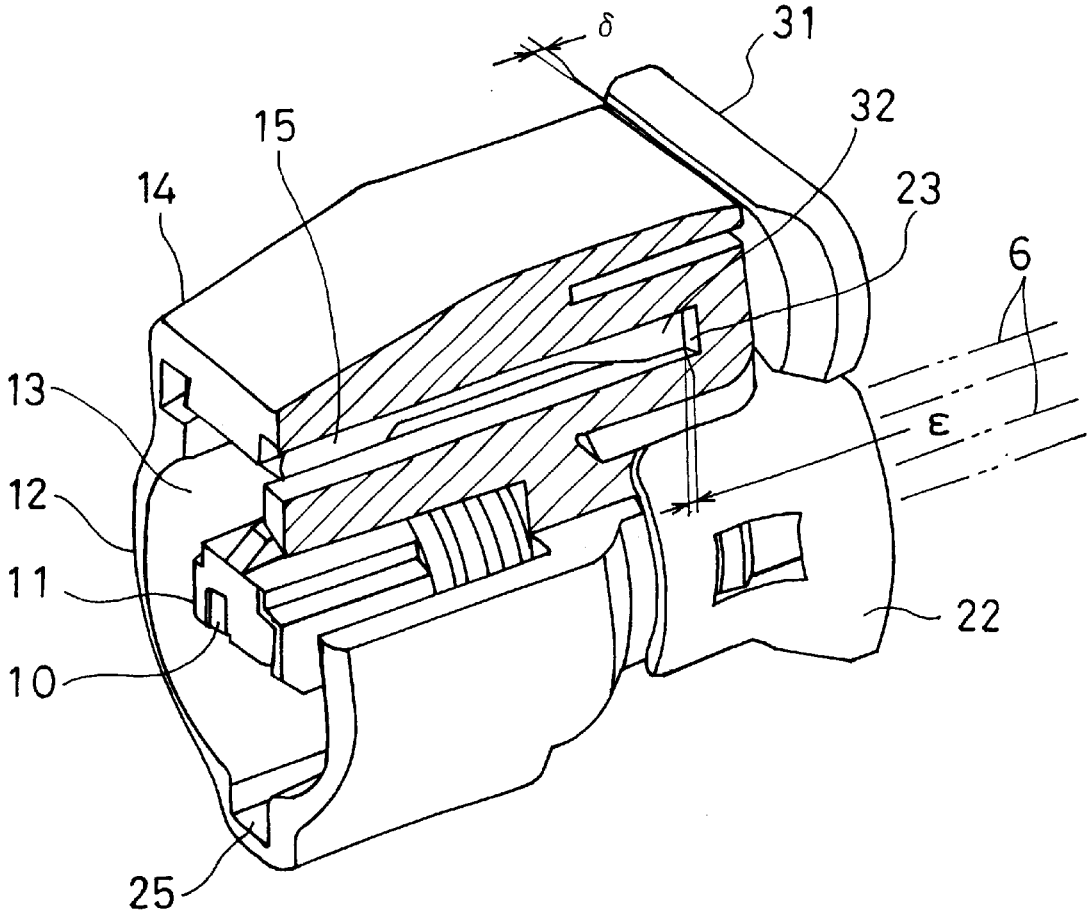
FIG. 3 is a perspective view in which one portion of a plug type housing engaged with the connector position assurance device is set to a side section.

FIG. 3 is a perspective view in which one portion of the plug type housing engaged with the connector position assurance device 4 is set to a side section. As shown in FIGS. 2 and 3, the plug type housing 2 has a central plug portion 11, a sleeve portion 12 and an enlarging portion 14. The central plug portion 11 holds a pair of female type terminal fittings 10. The sleeve portion 12 is extended onto the outer circumferential side from a base portion of the central plug portion 11 and a connector receiving space 13 is formed within the sleeve portion 12. The enlarging portion 14 is extended in the diametrical and axial directions from one portion of this sleeve portion 12, and an arm receiving space 15 for storing the lock arm 4 as the connector position assurance device is formed within the enlarging portion 14.

As shown in FIG. 2, a terminal storing chamber 16 for storing the pair of female type terminal fittings 10 is formed in the central plug portion 11. In the central plug portion 11, a retainer 17 is assembled from the side opposed to an insertion direction of the female type terminal fittings 10. A cantilevered lance (engaging arm portion) 18 adjacent to the terminal storing chamber 16 of the central plug portion 11 is arranged. A ferrite bead 19 for removing noises by surrounding an electrical wire 6 connected to the female type terminal fittings 10, and a rubber plug 20 for seal with respect to the electrical wire 6 are sequentially arranged in a base portion of the central plug portion 11. A seal ring 21 is fitted into the outer circumference of the central plug portion 11 on the deep side of the connector receiving space 13. A seal space is formed by this seal ring 21 between the plug type housing 2 and the receptacle type housing 3 described later. Reference numeral 22 of FIG. 3 designates a protecting cap for the electrical wire 6.

In FIG. 2, when the terminal fitting 10 is inserted, its tip is advanced while this tip pushes down the lance 18. The lance 18 is engaged with a hollow of the terminal fitting 10 having a rectangular shape in section by elastic restoring force so that the terminal fitting 10 attains a state unable to be extracted.

Figure 4:
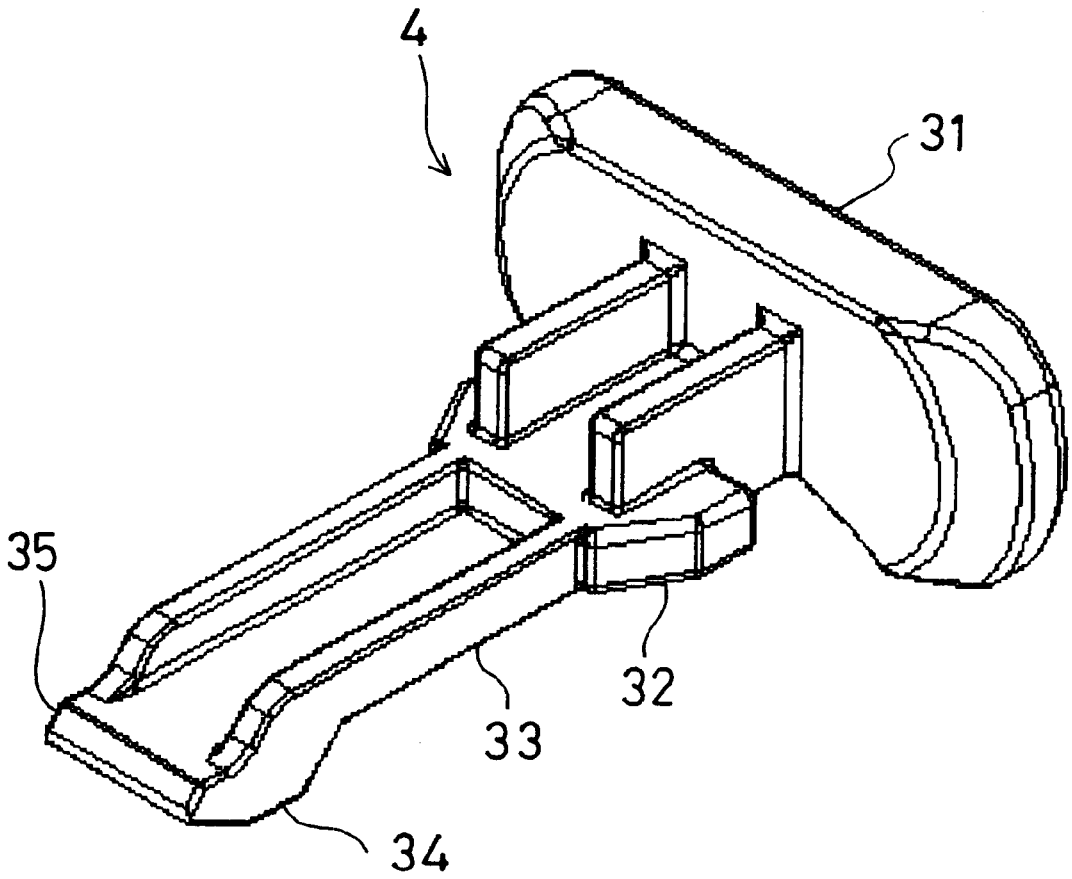
FIG. 4 is a perspective view of a lock arm engaged with the plug type housing in an inserting state.

FIG. 4 is a perspective view of the lock arm 4 engaged with the plug type housing 2 in an inserting state. The lock arm 4 has a pulling handle 31, a slide lock 32, an elastic arm 33, a fitting lock portion 34 inwardly directed at the tip of the elastic arm 33, and an engaging lock portion 35 outwardly directed at the tip of the elastic arm 33. The fitting lock portion 34 and the engaging lock portion 35 are arranged such that lock acting directions are opposed to each other. As shown in FIG. 3, the slide lock 32 is engaged with stages 23 formed on both sides of the arm receiving space 15. The lock arm 4 is slidably engaged by a predetermined clearance $\epsilon$ in the axial direction of the plug type housing 2 by an axial opening shape of this stage 23. As shown in FIG. 2, an engaging projection 24 is formed inwardly at the tip of the enlarging portion 14. Outward deformation of the elastic arm 33 is prevented by engaging the engaging projection 24 with the engaging lock portion 35 of the lock arm 4.

When the lock arm 4 is located in an advancing position, the clearance $\epsilon$ is widened and a clearance $\delta$ is narrowed so that the engaging lock portions 35 of the lock arm 4 and the engaging lock portions 24 of the enlarging portion 14 attain an engaging state. When the engaging lock portions 24, 35 are engaged, the elastic deformation of the arm 33 is prevented and the fitting of the fitting lock portion 34 is held.

When the lock arm 4 is located in a retreating position, the clearance $\epsilon$ is narrowed and the clearance $\delta$ is widened so that the engaging state of the engaging lock portions 35 of the lock arm 4 and the engaging lock portions 24 of the enlarging portion 14 is released. When the engaging state of the engaging lock portions 24, 35 is released, the deformation toward the outside of the arm 27 is allowed and the fitting of the fitting lock portion 34 is released.

The receptacle type housing 3 shown in FIG. 1 is arranged as one portion of a squib holder arranged in a gas generator for expanding an air bag. Electric energy required in ignition is supplied to the squib through pins 41 as two male type terminals. This receptacle type housing 3 is formed in a socket which has a base portion 42 projecting the pin 41 and also has a cylindrical portion 43 arranged around the pin 41 and projected from the base portion 42.

A fitting projection 44 against the fitting lock portion 34 of the lock arm 2, and a convex stripe 45 for positioning fitted to a groove 25 formed in the sleeve portion 12 of the plug type housing 2 are integrally arranged in the outer circumference of the cylindrical portion 43.

The short circuit insert 5 as a short circuit device is inserted into the sleeve portion 12 forming the socket. The short circuit insert 5 has a columnar main body 51 received within the sleeve portion 12 and also has a short circuit grip 52. An opening portion 53 opened on the upper face and both side faces is formed in the main body 51 such that the central plug portion 11 of the plug type housing 2 enters the opening portion 53. The short circuit grip 52 is integrally formed by an elastic electrically-conductive material and one portion of the tip of the grip 52 is deflected in a direction abutting on both the pins 41, and an electric short circuit is formed in an intermediate portion of the grip 52. The two pins 41 are electrically short-circuited as they are in a state in which this short circuit insert 5 is inserted into the receptacle type housing 3.

As clearly shown in FIG. 2, when the plug type housing 2 is fitted into the receptacle type housing 3, the retainer 17 deforms the short circuit grip 52 outside. Therefore, the electrical short circuit with respect to both the pins 41 is released. Simultaneously, since the fitting lock portion 34 at the tip of the lock arm 4 rides across the fitting projection 44 of the cylindrical portion 43, the fitting state of the plug type housing 2 to the receptacle type housing 3 is locked.

Figure 5:
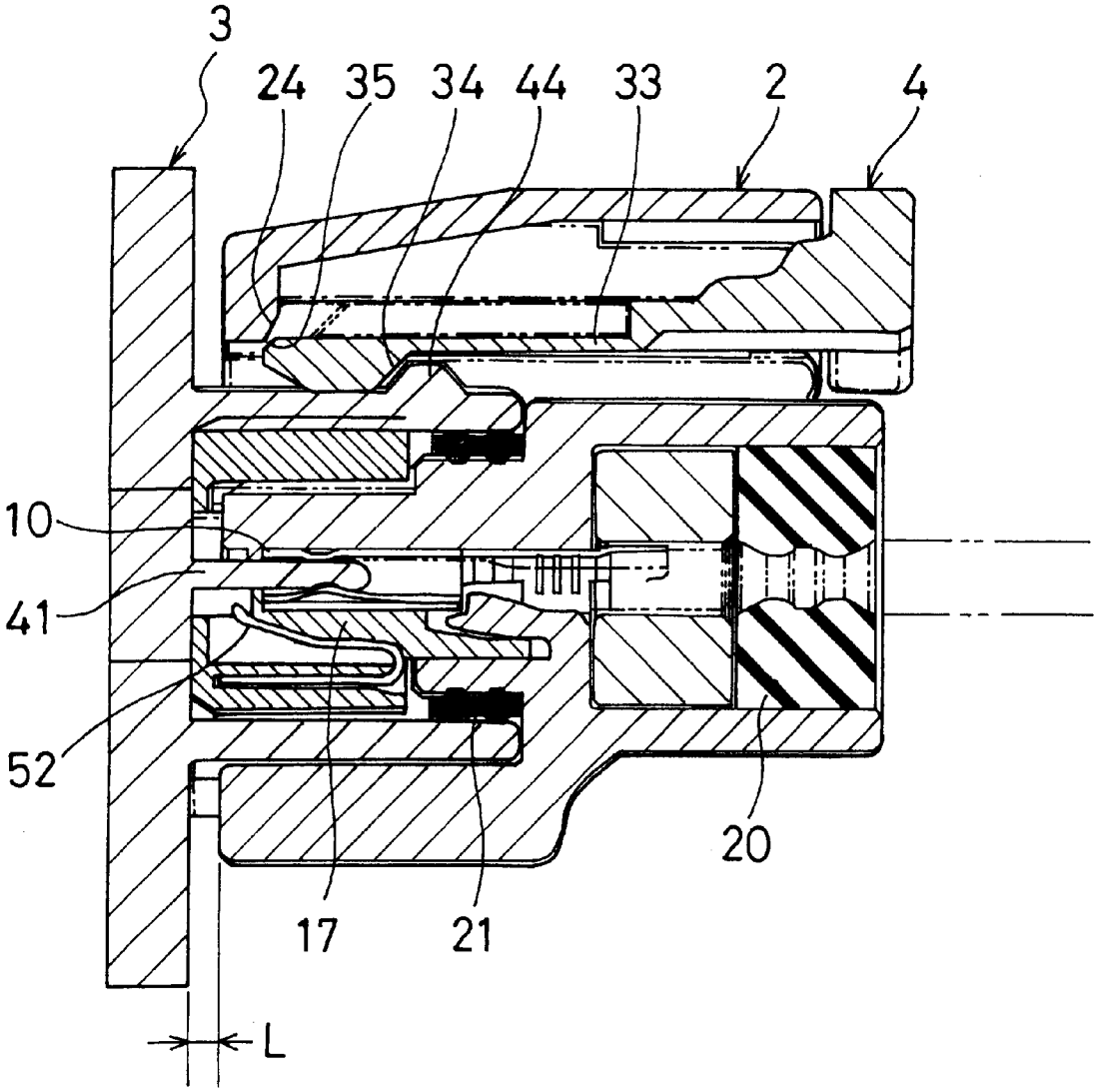
FIG. 5 is a sectional view showing states of both connector housings 2, 3 at a fitting state.
Figure 6:
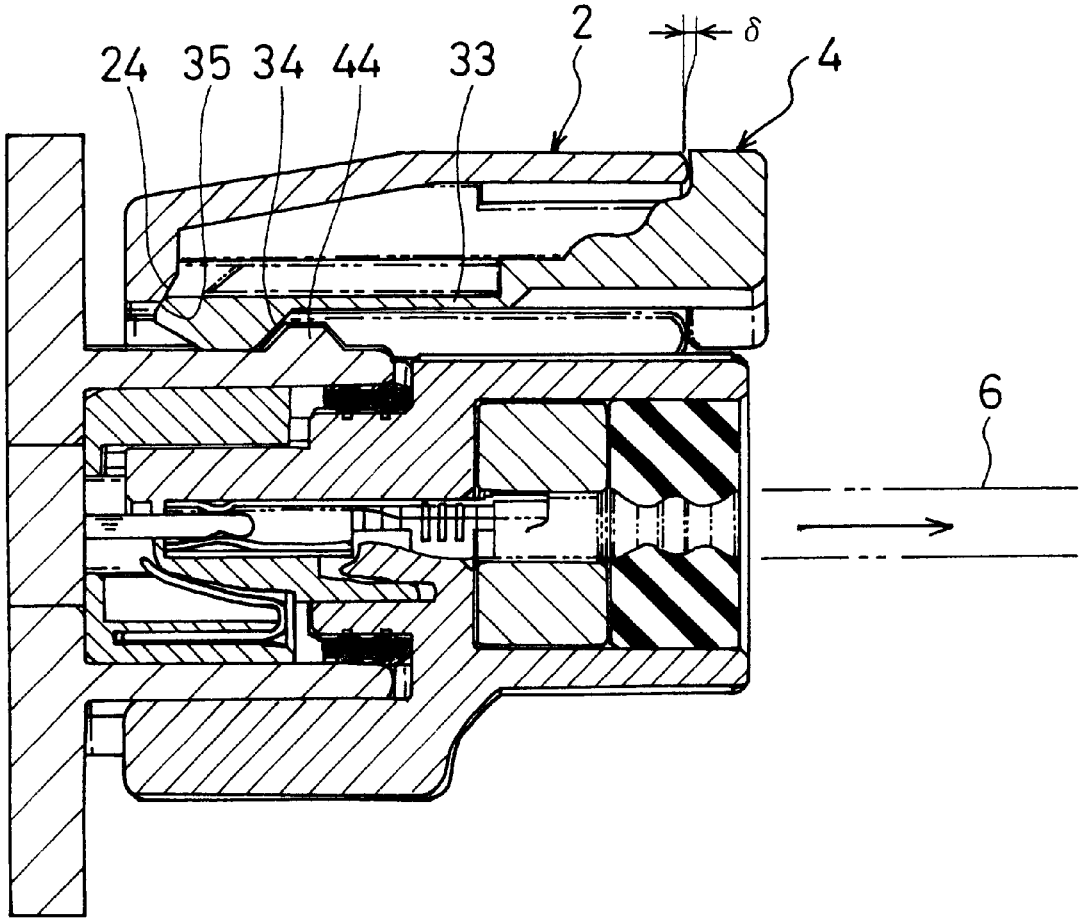
FIG. 6 is a sectional view showing the state of the plug type housing 2 at a separation preventing state.
Figure 7:
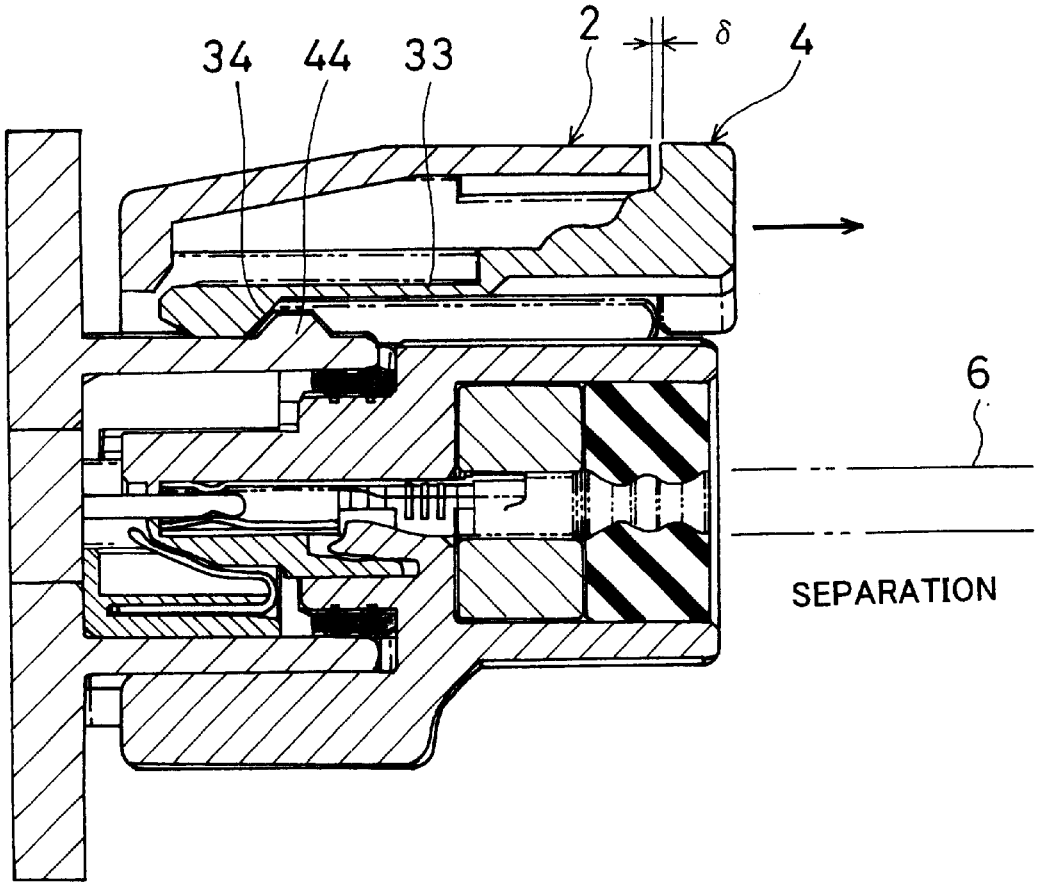
FIG. 7 is a sectional view showing the state of the plug type housing 2 at a separating state.

The operation of the electrical connector 1 of the above structure will be explained on the basis of FIGS. 5 to 7. FIG. 5 is a sectional view showing states of both the connector housings 2, 3 at a fitting state. FIG. 6 is a sectional view showing the state of the plug type housing 2 at a separation preventing state. FIG. 7 is a sectional view showing the state of the plug type housing 2 at a separating state.

In FIG. 5, when both the connector housings 2, 3 are fitted to each other, the lock arm 4 or both the plug type connector housing 2 and the lock arm 4 are pushed-in toward the receptacle type housing 3. Since the plug type connector housing 2 and the lock arm 4 are in a mutually movable state, engagement of the engaging lock portion 35 and the engaging projection 24 is not locked. Therefore, the elastic arm 33 is elastically deformed outside and the fitting lock portion 34 rides across the fitting projection 44 and is located in a fitting position shown in FIG. 5.

At this fitting state, the pin 41 as a male type terminal is fitted into the female type terminal fitting 10 and the electrical conduction between both the terminals is secured. Simultaneously, the electrical short circuit of the pin 41 is released by wedging-in the retainer 17 between the pin 41 and the short circuit grip 52. The fitting state of both the connector housings 2, 3 is simply confirmed by confirming whether e.g., an illustrated distance L is visually appropriate by the position relation of both the connector housings 2, 3.

When only the electrical wire 6 is pulled in a pulling direction of the plug type connector housing 2 in FIG. 6, the plug type connector housing 2 begins to be moved in the axial direction together with the electrical wire 6. However, the axial movement of the lock arm 4 is limited by the fitting of the fitting lock portion 34 and the fitting projection 44. Therefore, only the plug type connector housing 2 is moved toward the lock arm 4, and no clearance $\delta$ is almost formed. As a result, the engaging lock portion 35 and the engaging projection 24 attain the engaging state. Therefore, the deformation of the elastic arm 33 of the lock arm 4 is prevented and the release of the fitting of the fitting lock portion 34 and the fitting projection 44 is prevented. Namely, when only the electrical wire 6 is pulled, the separation of both the connector housings 2, 3 is prevented.

In FIG. 7, the lock arm 4 or both the plug type connector housing 2 and the lock arm 4 are pulled in a direction separated from the receptacle type housing 3. Since the plug type connector housing 2 and the lock arm 4 are in a mutually movable state, the clearance $\delta$ is secured and the engagement of the engaging lock portion 35 and the engaging projection 24 can be released. Therefore, the elastic arm 33 is elastically deformed outside, and the fitting lock portion 34 can ride across the fitting projection 44 so that the plug type connector housing 2 can be separated.

In accordance with the electrical connector assembly of the above embodiment mode, at the fitting state of both the connector housings 2, 3, both the connector housings 2, 3 can be fitted by only pushing-in the lock arm 4 or both the plug type connector housing 2 and the lock arm toward the receptacle type housing 3. The electrical short circuit of the male type terminal 41 can be also released at the same time as this fitting. Further, the fitting state can be simply visually confirmed by the position relation of both the connector housings 2, 3 in the fitting direction. Further, at the fitting time, both the connector housings 2, 3 can be hermetically sealed by the seal ring 21 and the rubber plug 20 (see FIG. 5). The lock arm 4 for holding the fitting of both the connector housings 2, 3 is arranged such that the lock arm 4 has no influence on the hermetical seal property of both the connectors outside these seal members 20, 21.

When only the electrical wire 6 of the plug type connector housing 2 is pulled, the release of the fitting of the fitting lock portion 34 and the fitting projection 44 is prevented so that both the connector housings 2, 3 are not pulled out. Therefore, the lock state of the fitting is secured. In the case of the normal extracting operation of the lock arm 4 or both the plug type connector housing 2 and the lock arm, i.e., the plug type connector housing 2, the fitting of the fitting lock portion 34 and the fitting projection 44 can be released so that both the connector housings 2, 3 can be separated.

In the above description, one preferred embodiment mode of the present invention is explained, but the present invention is not limited to the above embodiment modes, but can be variously designed and changed as long as the invention is described in the claims. For example, the male and female relations of both the connector housings 2, 3 may be reversely set. Further, the male and female relations of both the terminals 10, 41 may be reversely set. Further, the electrical connector is explained when the electrical connector has the short circuit insert. However, the electrical connector having no short circuit insert may also be used. Further, the number of terminals is not limited to two, but the electrical connector having three or more terminals arranged in one or plural lines may be also used. Further, it is not limited to the electrical connector in the case of the formation of a water tight seal to a terminal portion, but the electrical connector requiring no water tight seal may be also used.

What is claimed is:

1. An electrical connector assembly comprising:

a pair of connector housings able to be fitted, and a lock arm engaged with one of these connector housings and holding a fitting state of the pair of connector housings when said pair of connector housings is fitted;

wherein said lock arm has a fitting lock portion fitted to the other connector housing, and an engaging lock portion engaged with said one connector housing in a releasing direction of said fitting lock portion;

said engaging lock portion is arranged in said lock arm such that said engaging lock portion prevents the release of said fitting lock portion when only said one connector housing begins to be separated, and such that the release of said fitting lock portion is not prevented by said engaging lock portion when said lock arm begins to be separated from said other connector housing together with said one connector housing.

2. An electrical connector assembly according to claim 1, wherein said lock arm has an elastic arm, and said fitting lock portion and said engaging lock portion are arranged at the tip of this elastic arm such that operating directions of the fitting lock portion and the engaging lock portion are opposed to each other.

3. An electrical connector assembly according to claim 2, wherein said lock arm is movably arranged in a fitting direction with respect to said one connector housing, and said engaging lock portion is switched to an engaging position and a releasing position by this movement.

4. A connector comprising:

a mating side connector;

a connector housing fitted to this mating side connector;

a connector position assurance device having an elastic arm for fitting to this mating side connector;

an engaging portion engaged within said connector housing and arranged on a side directed to the exterior of the tip of said elastic arm; and a fitting portion arranged on a side directed to the interior of the tip of said elastic arm with respect to said mating side connector;

wherein said elastic arm is movably engaged with said connector housing in an axial direction in a position engaged with said engaging portion and a position disengaged from said engaging portion; and said engaging portion is arranged in said elastic arm such that said engaging portion is located in the engaging position when said mating side connector begins to be detached from said connector housing, such that said engaging portion is located in the disengaging position when both said connector housing and said elastic arm begin to be detached from said mating side connector.

* * * * *